US012741170B2

(12) United States Patent
Conant et al.

(10) Patent No.: US 12,741,170 B2
(45) Date of Patent: Sep. 22, 2026

(54) COLLAR FOR A BARBELL

(71) Applicant: Nike, Inc., Beaverton, OR (US)

(72) Inventors: Andrew P. Conant, Lake Oswego, OR (US); Gabrielle A. Rudd, Lake Oswego, OR (US); Rafer Stromme, Vancouver, WA (US)

(73) Assignee: NIKE, INC., Beaverton, OR (US)

( * ) Notice: Subject to any disclaimer, the term of this patent is extended or adjusted under 35 U.S.C. 154(b) by 113 days.

(21) Appl. No.: 18/784,077

(22) Filed: Jul. 25, 2024

(65) Prior Publication Data

US 2025/0090891 A1 Mar. 20, 2025

Related U.S. Application Data

(60) Provisional application No. 63/582,903, filed on Sep. 15, 2023.

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ..... A63B 21/0728; A63B 21/0724
See application file for complete search history.

(56) References Cited

U.S. PATENT DOCUMENTS

| | | | | |
|---|---|---|---|---|
| 7,513,856 | B2 | 4/2009 | Jones | |
| 8,827,878 | B1 * | 9/2014 | Ciminski | A63B 21/0728 482/93 |
| 11,324,986 | B2 * | 5/2022 | Kehlenbach | A63B 21/08 |
| D971,720 | S * | 12/2022 | Jones | D8/396 |
| 11,607,576 | B2 * | 3/2023 | Stilson | A63B 21/0724 |
| D1,001,928 | S * | 10/2023 | Jones | D21/694 |
| 2009/0325769 | A1 * | 12/2009 | Miskel | A63B 21/075 482/107 |
| 2011/0162173 | A1 * | 7/2011 | Ciminski | F16B 2/10 16/421 |
| 2020/0094100 | A1 * | 3/2020 | Garcia Castillo | A63B 21/0601 |
| 2022/0143453 | A1 * | 5/2022 | Martin | F16B 2/06 |
| 2022/0355153 | A1 * | 11/2022 | Abbott | A63B 21/0724 |
| 2024/0033557 | A1 * | 2/2024 | Duplain | A63B 21/0728 |

* cited by examiner

*Primary Examiner* — Zachary T Moore
(74) *Attorney, Agent, or Firm* — BOOKOFF MCANDREWS PLLC

(57) ABSTRACT

A collar for a barbell, the collar having a first collar portion having a body extending along a curve, wherein the body includes: an outer radial surface; an inner radial surface; a channel extending between the outer radial surface and the inner radial surface; a blockage disposed within the channel, wherein the blockage comprises an elastomeric material; and a first pad extending radially inward from the inner radial surface of the first collar portion, wherein first pad includes the same elastomeric material of the blockage, and wherein the first pad is integral with the blockage disposed within the channel.

20 Claims, 7 Drawing Sheets

COLLAR FOR A BARBELL

CROSS-REFERENCE TO RELATED APPLICATION(S)

This patent application is a continuation of and claims the benefit of priority to U.S. Application No. 63/582,903, filed on Sep. 15, 2023, the entirety of which is incorporated herein by reference.

FIELD

This disclosure relates generally to the field of weight training devices, and more particularly to collars for barbells and dumbbells that use removable weights.

BACKGROUND

This section provides background information related to the present disclosure which is not necessarily prior art.

Barbell retention devices (for example, barbell collars) generally hold weight plates in place when the weight plates are disposed on a barbell. Present weight plate retention devices have durability issues. In particular, adhesives used in barbell collars wear out and fail over time.

BRIEF DESCRIPTION OF THE DRAWINGS

The detailed description of the invention will be described in relation to the accompanying drawings. In the drawings, the following figures have the following general nature.

Corresponding reference numerals indicate corresponding parts throughout the several views of the drawings.

DETAILED DESCRIPTION

Figure 1:
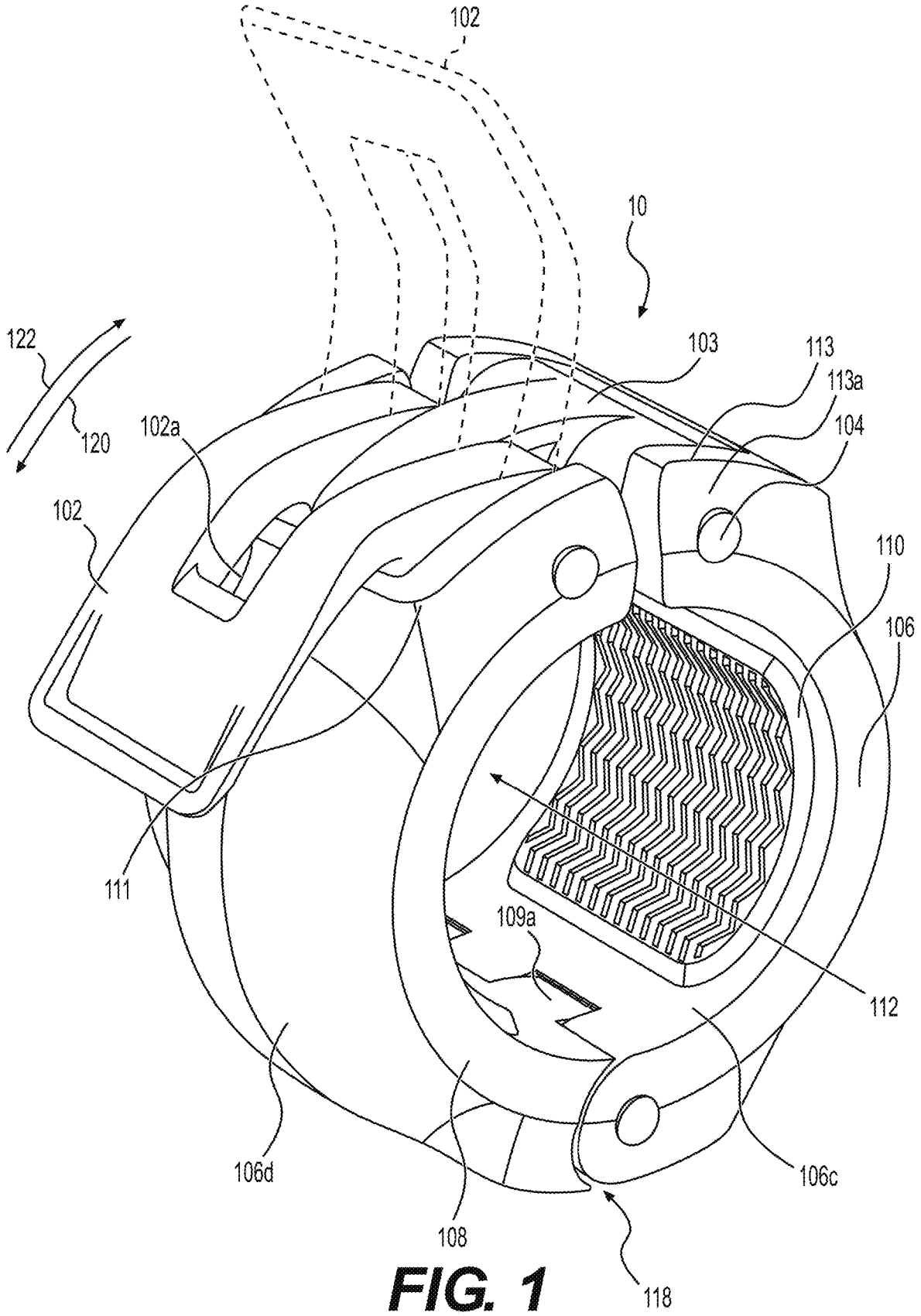
FIG. 1 is a perspective view of a collar.

The present disclosure relates to barbell collars using mechanical locking action to secure rubber or elastomer pads to the collar. In embodiments, the present disclosure simplifies collar manufacture and results in a more durable collar.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about," "approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to when the collar is upright on a flat, level surface.

The subject matter of embodiments of the present disclosure is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly stated.

FIG. 1 depicts a snap-lock barbell collar 10. Barbell collars are placed onto barbell or dumbbell sleeves that have been loaded with weight (for example, weight plates). The snap-lock collar of FIG. 1 is generally circular-shaped and includes a clip that opens and closes to move the collar 10 interchangeably between a first unlocked position and a second locked position. In the first unlocked position, the collar 10 is configured to slide on and off of a barbell sleeve (not shown). In the second locked position, the collar 10 is configured to clamp around the barbell sleeve in order to resist movement of the collar 10 (and any attached weight plates) relative to the sleeve.

The collar 10 includes a lever 102, a cam 103, one or more pins 104, a first collar portion 106, a second collar portion 108, and one or more pads 110. The first collar portion 106 is directly coupled to the second collar portion 108 at a knuckle hinge 118. At an opposing end of collar 10 (approximately 180 degrees from knuckle hinge 118), first collar portion 106 and second collar portion 108 may be indirectly coupled to one another via lever 102 and cam 103. Lever 102 is directly coupled to second collar portion 108 at a knuckle joint 111. Cam 103 also forms a portion of the knuckle joint 111. At knuckle joint 111, second collar portion 108 forms the outermost knuckles, cam 103 forms the innermost knuckle, and lever 102 includes intermediate knuckles that surround lever 102 and are radially inward of the knuckles of second collar portion 108. The knuckle joint 113 includes a first knuckle 113*a* and a second knuckle 113*b* (best shown below in FIGS. 2A and 2B). The knuckle hinge 118 includes one or more first (inner) knuckles 109*a* and one or more second (outer) knuckles 109*b* (best shown below in FIGS. 2A and 2B).

As further shown in FIG. 1, lever 102 has an opening 102*a* that extends along a portion of lever 102. Opening 102*a* receives a portion of cam 103, allowing lever 102 and cam 103 to move relative to one another. Cam 103 is directly coupled to first collar portion 106 by the knuckle joint 113. Collar 10 is moved from the first unlocked position (shown in dashed lines) to the second locked position by moving lever 102 in a first rotational direction 120. Collar 10 is moved from the second locked position to the first unlocked position by moving lever 102 in a second rotational direction 122, that is opposite of the first rotational direction.

Collar 10 defines a receiving area 112 that is an open space. The components of collar 10, in particular first collar portion 106, second collar portion 108, lever 102, and cam 103, circumferentially surround receiving area 112. The sleeve of a barbell or loadable dumbbell may extend through receiving area 112.

First collar portion 106 includes a pad 110 extending radially inward into receiving area 112. As discussed further below, pad 110 may be formed from a rubber or other material with similar properties. For example, pad 110 may be a high-friction material to help prevent collar 10 from sliding off of a barbell sleeve when clamped into the locked position. Furthermore, pad 10 also enables collar 10 to be placed under heavy load without damaging the pad of the barbell sleeves on which collar 10 is used.

Figure 2A:
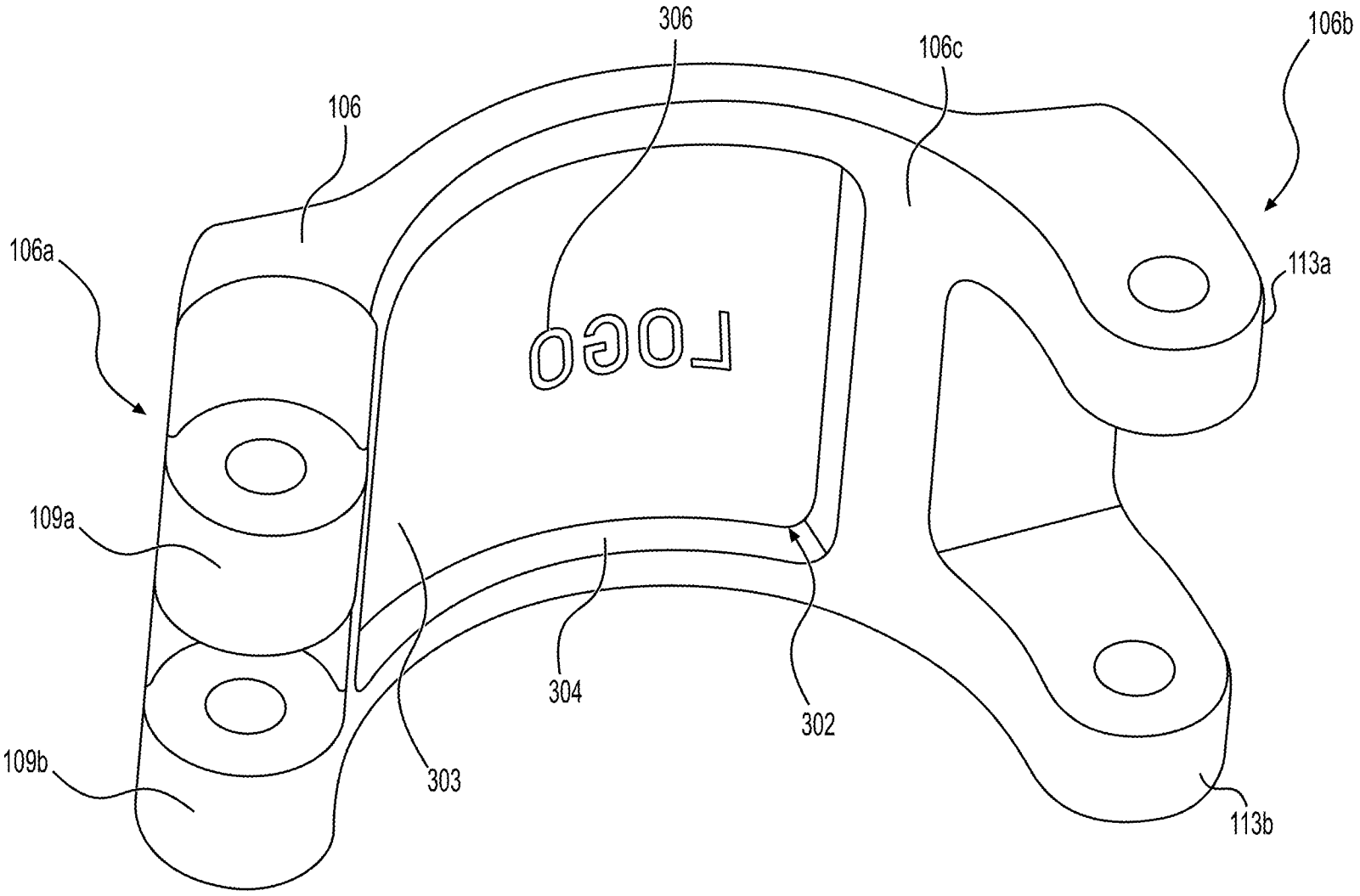
FIG. 2A is a perspective view of a first portion of the collar of FIG. 1 without an internal pad.

Referring to FIG. 2A, first collar portion 106 extends along an arc or semicircle from a first end 106*a* toward a second end 106*b*. Second collar portion 108 may be substantially similar in shape to first collar portion 106 such that when the two portions are joined with one another, they form a generally C-shaped or circular clamp.

First collar portion 106 includes an interior surface 106*c* (that faces receiving area 112 when collar 10 is assembled) and an outer surface 106*d* (shown below in FIG. 3A) that forms part of the exterior surface of collar 10. Interior surface 106*c* includes a recess 302. In some examples, the shape of recess 302 follows the curvature of first collar portion 106. That is, the recess 302 itself may extend along an arc. Recess 302 may have a uniform depth, or a variable depth. Recess 302 may have a generally rectangular profile, and as shown in FIG. 2A, has a rounded rectangular profile. However, this shape is not limiting, and recess 302 may have a rectangular, square, diamond, circular, ovular, of irregularly shaped profile.

Recess 302 is defined by a base surface 303, and a rim 304 extending upward and surrounding the periphery of the base 303. Base 303 may be a substantially smooth and continuous surface except for one or more channels 306. Thus, in at least some embodiments, base 303 does not include any unitary protrusions, ridges, support structures, or the like that extend radially inward from base 303. First collar portion 106 includes a plurality of channels 306 extending through the base 303 to the outer surface 106*d*. Thus, in an initial configuration as shown in FIG. 2A, channels 306 are in fluid communication with recess 302.

The channels 306 may be arranged in any suitable manner, for example, to create a word, image, character, or the like. For example, as shown in the figures, first collar portion 106 has four channels 306, where each channel 306 is in the shape of an alphanumeric character. As will be described in greater detail below, the channels 306 may be injected or filled with an elastomeric material (e.g., a thermoplastic elastomer or thermoset elastomer) from the direction of outer surface 106*d*, which can flow through channels 306 and into recess 302 to form one of the pads 110.

Figure 2B:
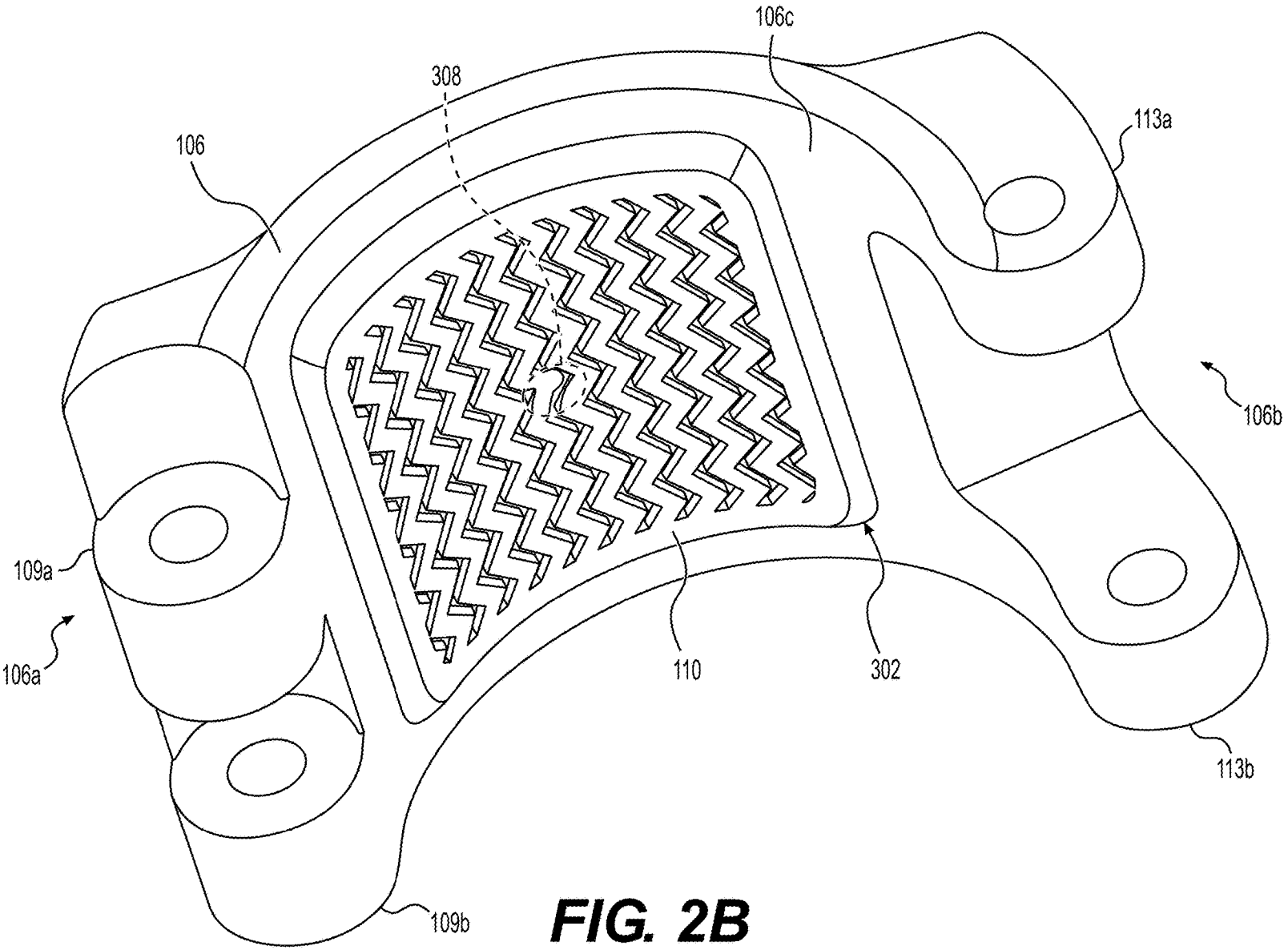
FIG. 2B is an inside view of a first portion of the collar of FIG. 1 with an internal pad attached.

FIG. 2B shows the first collar portion 106 with the formed pad 110. Pad 110 may fill recess 302, and extend further radially inward (into receiving area 112) than any surface of first collar portion 106. Pad 110 may thus directly engage with the outer surface of a barbell sleeve when collar 10 is locked onto the barbell sleeve. The outer perimeter of pad 110 may include a chamfer as shown, but other suitable perimeter shapes are also contemplated, such as, e.g., a sharp corner, flat edge, fillet, or the like. The exposed outer surface of pad 110 may include one or more patterns, such as the wavy line pattern shown in the figures. The pattern may be recessed into the outer surface of pad 110, or patterns may be formed by protrusions extending away from the outer surface of pad 110. In yet other embodiments, a combination of recessed and protruding features may be used. Still further, the outer surface of pad 110 may be smooth and/or continuous.

In some embodiments, pad 110 is coupled to first collar portion 106 only by mechanical interlocking. Thus, in some embodiments, there is no chemical bonding between pad 110 and surfaces of first collar portion 106. In other words, collar 10 is substantially free of any adhesive bonding the pad 110 to the first collar portion 106. More specifically, there is no chemical bonding between pad 110 and any other portion of collar 10. Furthermore, in the embodiment shown, there is no adhesive used to couple pad 110 to first collar portion 106 or any portion of collar 10. Thus, in some embodiments, collar 10 is completely free of (i.e., lacking any) adhesive.

As further discussed below, pad 110 may be formed from one or more elastomeric materials. Because of the injection flow of the elastomeric material through channels 306 and into recess 302, the elastomeric material of pad 110 is integrally formed with elastomeric material positioned inside of channels 306. In other words, the elastomeric material substantially or completely occludes the channels 306. The integration of the elastomeric material occluding channels 306 with the elastomeric material disposed within recess 302 and extending out of recess 302 forms a mechanical interlock for pad 110 to first collar portion 106, eliminating the need for adhesives to secure pad 110 to first collar portion 106.

In some examples, the recess 302 and the pad 110 extends along about 20% to about 90% of a surface area of the inner surface 106*c*. In some examples, the recess 302 and the pad 110 extends along about 20% to about 80% of a surface area of the inner surface 106*c*. In some examples, the recess 302 and the pad 110 extends along about 20% to about 50% of a surface area of the inner surface 106*c*. The recess 302 and the pad 110 extends along a portion of a surface area of the inner surface 106*c* as desired for securing an external member within the collar 10.

Figure 3A:
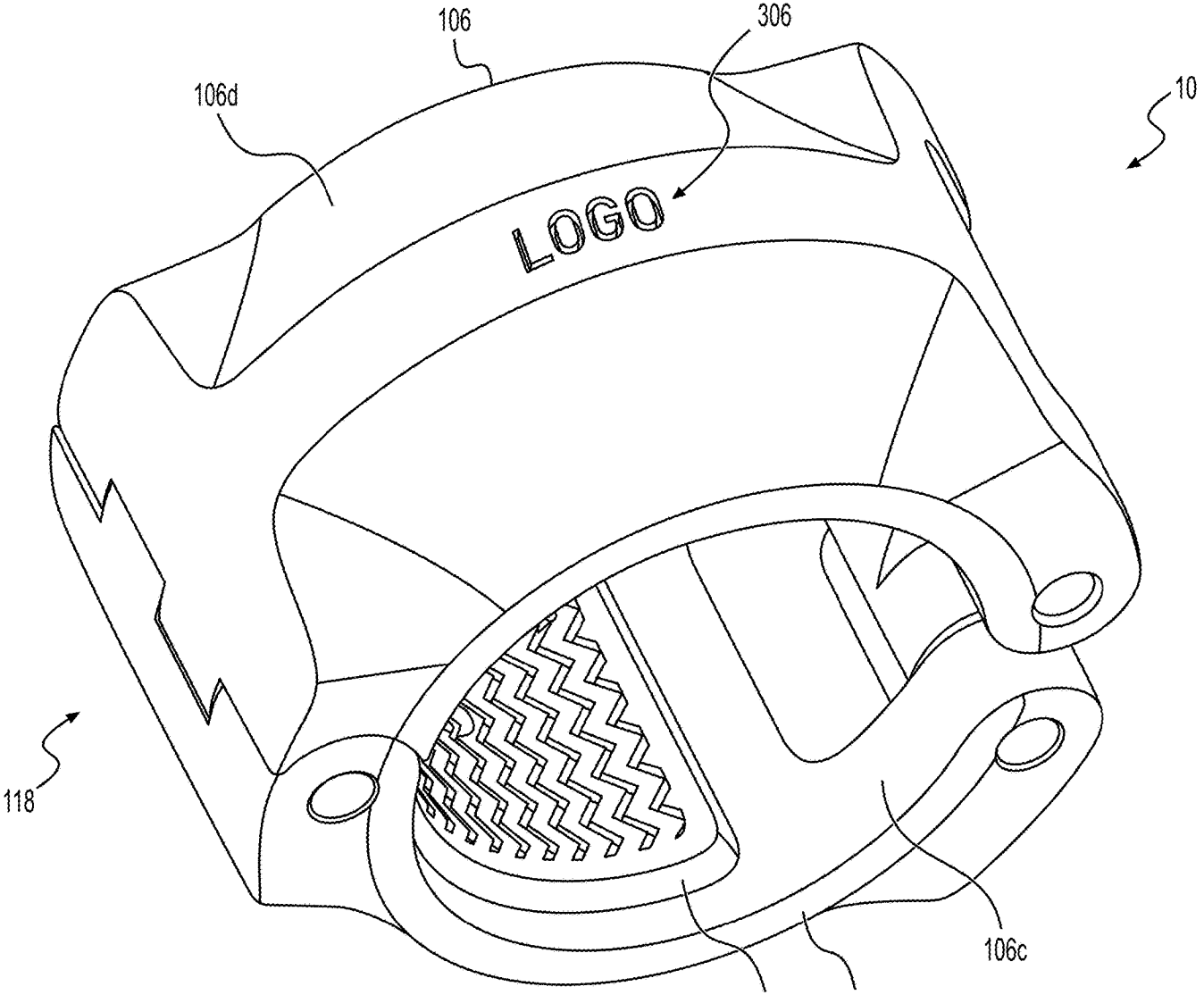
FIG. 3A is another perspective view of the collar of FIG. 1.
Figure 3B:
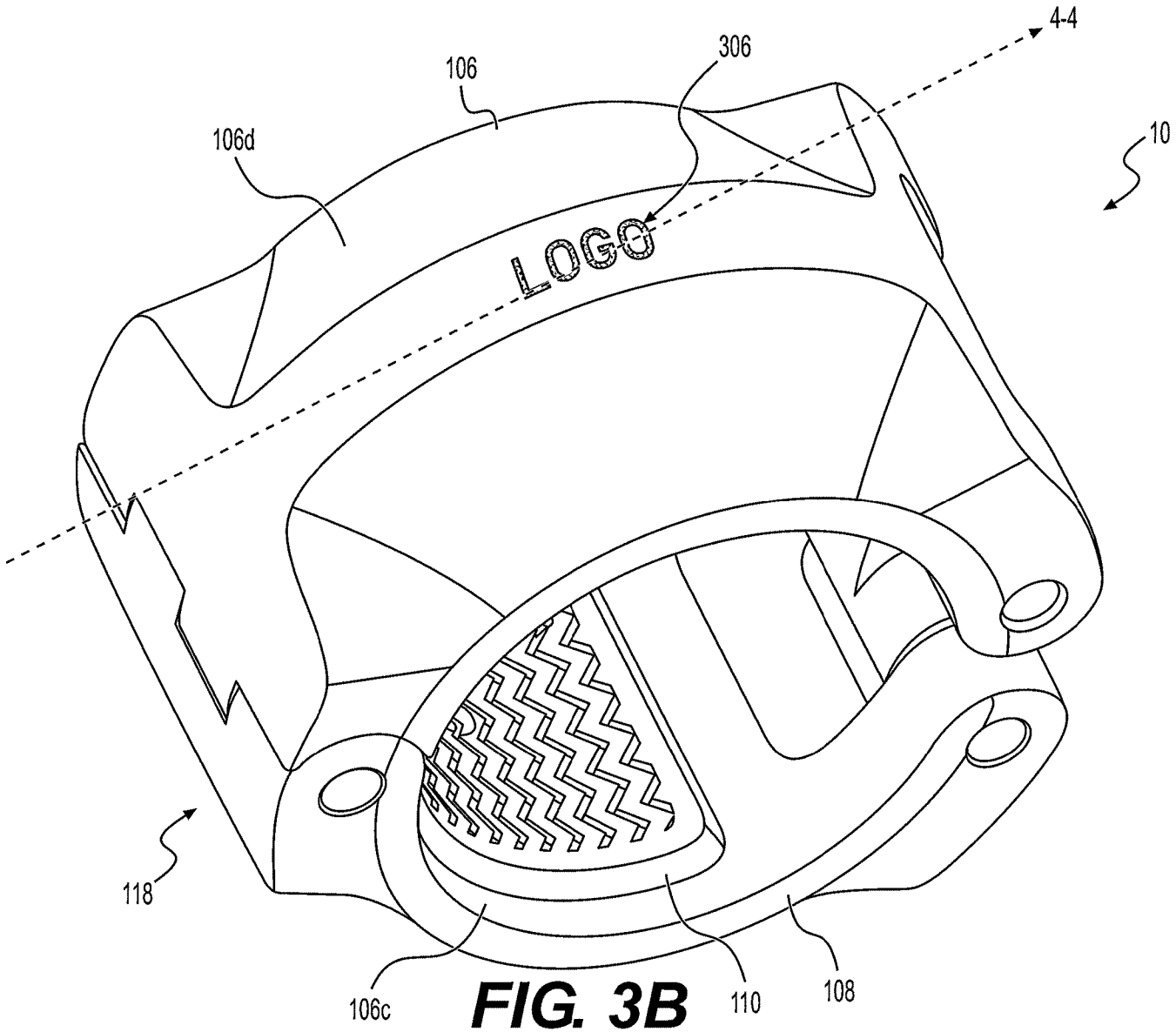
FIG. 3B is another perspective view of the collar of FIG. 1.

For illustrative purposes, FIG. 3A shows an assembled collar 10, with first collar portion 106 lacking a pad 110 so that channels 306 are empty. FIG. 3B shows an assembled collar 10, taken from the same perspective shown in FIG. 3A. However, in FIG. 3B, first collar portion 106 includes as assembled pad 110 (hidden from view, except for the portion of the elastomeric material visible within channels 306).

Figure 4:
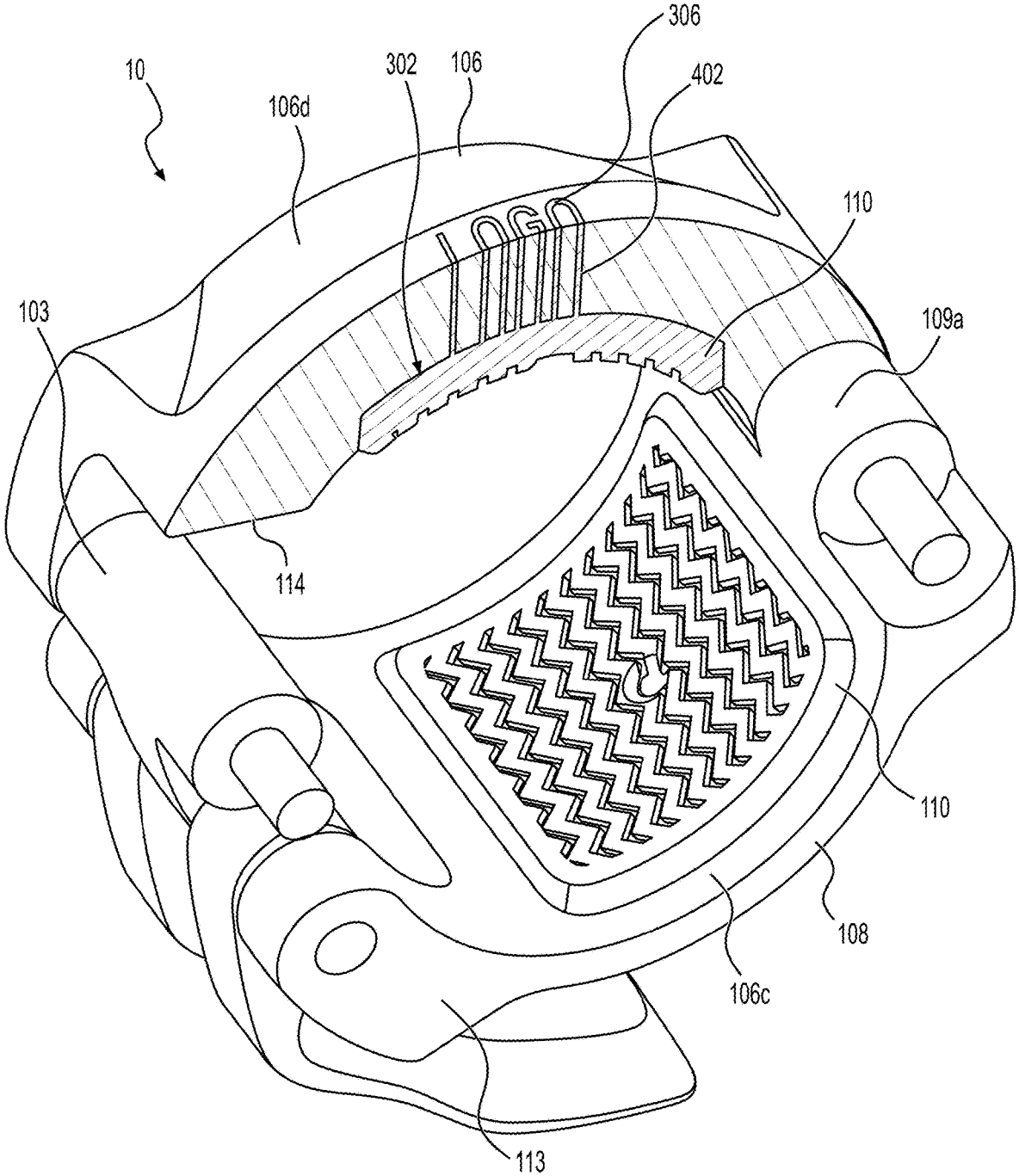
FIG. 4 is a cross-sectional view of the collar of FIG. 3B taken along line 4-4.

Referring to FIG. 4, collar 10 is shown with a cross-section taken along line 4-4 (shown in FIG. 3B) of the first collar portion 106. The first collar portion 106 further includes the one or more channels 306. As previously discussed, the pad 110 fills the channels 306 when injected thus forming one or more blockages 402. In other words, the blockages 402 are disposed within the channels 306 extending from the pad 110 to the outer surface 106*d*. The blockages 402 are formed from the one or more elastomeric materials. The channels 306 allow for fluid communication during the manufacturing process of the collar 10 when in the unfilled state, as will be described in greater detail below. Although only the first collar portion 106 is primarily shown and discussed for illustrative purposes, the second collar portion 108 may be similarly formed.

Figure 5:
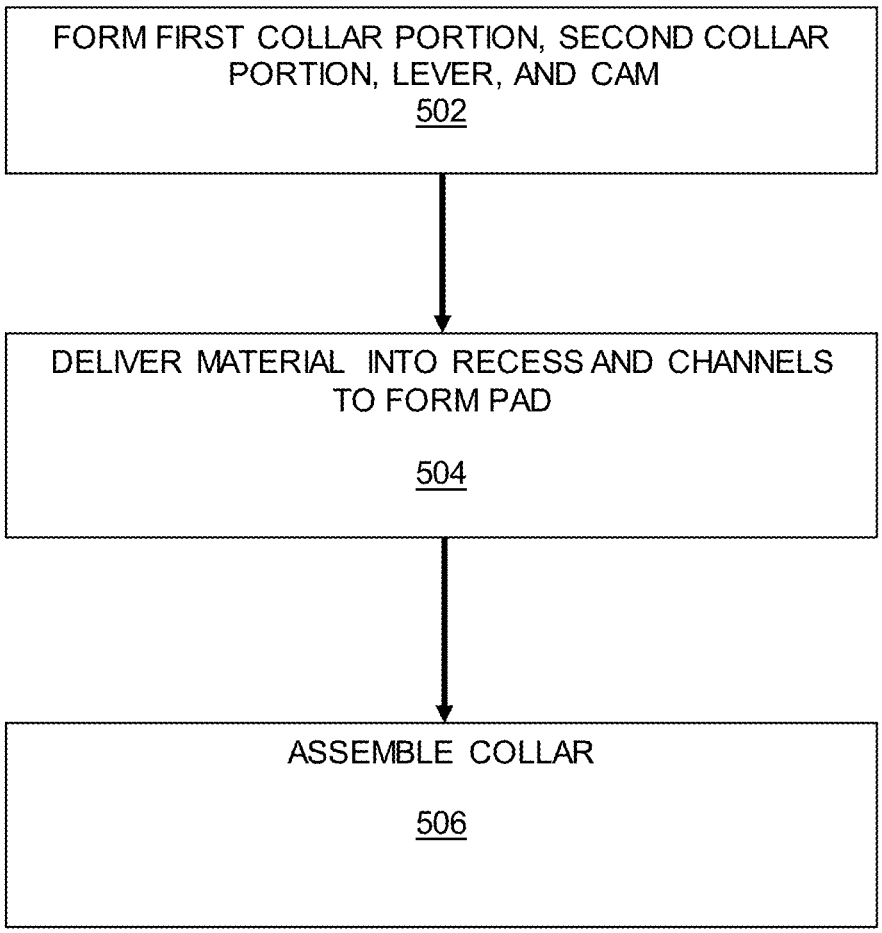
FIG. 5 is a flowchart describing a method of manufacturing an exemplary collar.

Referring to the flowchart FIG. 5, in some examples, one or more portions of the collar 10 are formed by a molding process (e.g. injection molding, compression molding, transfer molding, overmolding, and the like). In an example, the pad 110 may be formed or manufactured during an injection overmolding process. At step 502, the collar portions 106, 108, lever 102, and cam 103 are formed during various molding processes. During the manufacture of first collar portion 106 and second collar portion 108, channels 306 are formed through their respective surfaces. Channels 306 may be formed as part of the molding process or may be formed after molding, such as by etching, cutting, machining or the like.

At step 504, the pad 110 is formed onto first collar portion 106 and/or second collar portion 108. Pad 110 is formed during an overmolding process. In the overmolding process, the elastomeric material may be delivered into the recess 302. The elastomeric material is delivered to a sprue (not shown) and through a gate 308 (shown above in FIG. 2B) into the recess 302. Prior to filling, channels 306 are in fluid communication with recess 302, and thus the elastomeric material flowing into recess 302 will also fill channels 306. The elastomeric material is solidified (e.g., cooled for thermoplastic elastomers or cured for thermoset elastomers) and the sprue is removed from the formed pad 110. During this overmolding process, no adhesives are necessary to connect pad 110 to the first collar portion 106 (or to the second collar portion 108). Only the mechanical interlocking of the pad 110 including the material disposed within the channels 306 keeps the pad 110 disposed within the recess 302. The pad 110 is a single continuous and unitary piece of solidified thermoplastic elastomer (including those portions solidified within channels 306).

Once the pad 110 is formed, at step 506, the collar 10 is assembled using the formed components (the lever 102, the cam 103, the one or more pins 104, the first collar portion 106, the second collar portion 108, and the one or more pads 110). This method of manufacture the pad 110 reduces movement of the pad 110 in the assembled collar 10 and is achieved without the use of any adhesive within the collar 10.

In some examples, the first collar portion 106 and the second collar portion 108 may be formed from a suitable hard material such as, a metal or metal alloy, a durable plastic (e.g., a polyamide, a polycarbonate, polyurethane, etc.), or the like. In one example, first collar portion 106 and second collar portion 108 are formed from a glass-filled Nylon 66 polymer. However, many other suitable materials also are contemplated.

In some examples, the elastomeric material for the pad 110 may include one or more thermoplastic elastomers. Nonlimiting examples of suitable thermoplastic elastomers include thermoplastic polyurethane elastomers, thermoplastic polyurea elastomers, thermoplastic polyamide elastomers (PEBA or polyether block polyamides), thermoplastic polyester elastomers, metallocene-catalyzed block copolymers of ethylene and α-olefins having 4 to about 8 carbon atoms, and styrene block copolymer elastomers such as poly(styrene-butadiene-styrene), poly(styrene-ethylene-co-butylene-styrene), and poly(styrene-isoprene-styrene).

Thermoplastic polyurethane elastomers may be selected from thermoplastic polyester-polyurethanes, polyether-polyurethanes, and polycarbonate-polyurethanes, including, without limitation, polyurethanes polymerized using as polymeric diol reactants polyethers and polyesters including polycaprolactone polyesters.

Since many possible embodiments may be made of the invention without departing from the scope thereof, it is to be understood that all matter herein set forth or shown in the accompanying drawings is to be interpreted as illustrative and not in a limiting sense.

The following clauses provide an exemplary configuration for an article of footwear and sole structure described above.

Clause 1. A collar for a barbell, the collar comprising: a first collar portion having a body extending along a curve, wherein the body includes: an outer radial surface; an inner radial surface; and a channel extending between the outer radial surface and the inner radial surface, a blockage disposed within the channel, wherein the blockage comprises an elastomeric material, a first pad extending radially inward from the inner radial surface of the first collar portion, wherein the first pad includes the same elastomeric material of the blockage, wherein the first pad is integral with the blockage disposed within the channel.

Clause 2. The collar of Clause 1, further including a second collar portion having a body extending along a curve, wherein the first collar portion and the second collar portion are coupled to one another and circumscribe an opening extending between the first collar portion and the second collar portion.

Clause 3. The collar of Clause 2, wherein the body of the second collar portion includes: a second outer radial surface; a second inner radial surface; and a second channel extending between the outer radial surface and the inner radial surface, wherein the collar further includes a second pad extending radially inward from the inner radial surface of the second collar portion, wherein the second channel includes a second blockage, and wherein the second blockage is integral with the second pad.

Clause 4. The collar of Clause 1, wherein the elastomeric material comprises a thermoplastic elastomer.

Clause 5. The collar of Clause 1, wherein the collar is substantially free of any adhesive bonding the first pad to the first collar portion.

Clause 6. The collar of Clause 1, wherein the channel is in the shape of an alphanumeric character.

Clause 7. The collar of Clause 1, wherein the first pad is mechanically interlocked to the first collar portion.

Clause 8. The collar of Clause 1, wherein the inner radial surface of the first collar portion includes a recess, wherein the recess is defined by a base surface and a rim extending radially inward from the base surface.

Clause 9. The collar of Clause 8, wherein the first pad is disposed at least partially within the recess.

Clause 10. The collar of Clause 1, wherein the channel is one of a plurality of spaced-apart channels extending between the outer radial surface and the inner radial surface of the first collar portion, wherein each of the channels is filled with elastomeric material that is integral with the elastomeric material of the first pad.

Clause 11. A collar for a barbell, the collar comprising: a first collar portion having a body extending along a curve, wherein the body includes: an outer radial surface; and an inner radial surface; a first pad extending radially inward from the inner radial surface of the first collar portion, wherein the first pad includes an elastomeric material mechanically interlocked to the inner radial surface of the first collar portion.

Clause 12. The collar of Clause 11, wherein the collar is substantially free of any adhesive bonding the first pad to the first collar portion.

Clause 13. The collar of Clause 11, further comprising a channel in the shape of an alphanumeric character and extending between the outer radial surface and the inner radial surface.

Clause 14. The collar of Clause 11, further including a second collar portion having a body extending along a curve, wherein the first collar portion and the second collar portion are coupled to one another and circumscribe an opening extending between the first collar portion and the second collar portion.

Clause 15. The collar of Clause 14, wherein the body of the second collar portion includes: a second outer radial surface; a second inner radial surface; and a channel extending between the second outer radial surface and the second inner radial surface, wherein the collar further includes a second pad extending radially inward from the inner radial surface of the second collar portion, wherein the channel includes a blockage, and wherein the blockage is integral with the second pad.

Clause 16. A method of manufacturing a collar for a barbell, the method comprising: injecting an elastomeric material into one or more channels disposed in an outer radial surface of a first portion of the collar, such that the elastomeric material flows through the one or more channels and into a recess of an inner radial surface of the first portion of the collar; and solidifying the elastomeric material in the one or more channels and the recess to produce a pad at least partially disposed within the recess and mechanically interlocked to the first portion of the collar.

Clause 17. The method of Clause 16, further comprising: injecting the elastomeric material into one or more channels disposed in a second outer radial surface of a second portion of the collar, such that the elastomeric material flows through the one or more channels disposed in the second outer radial surface of the second portion of the collar and into a second recess of a second inner radial surface of the second portion of the collar; and solidifying the elastomeric material in the one or more channels disposed in the second outer radial surface of the second portion of the collar and the second recess to produce a second pad at least partially disposed within the second recess and mechanically interlocked to the second portion of the collar.

Clause 18. The method of Clause 17, further including coupling the first portion and the second portion to one another at a hinge joint so that 1) the first portion and the second portion form the collar surrounding an opening, and 2) the pads from both the first portion and the second portion extend radially inward toward the opening.

Clause 19. The method of Clause 16, wherein the one or more channels are arranged in an alphanumeric shape.

Clause 20. The method of Clause 16, wherein the pad is mechanically interlocked to the first portion without any adhesive.

The invention claimed is:

1. A collar for a barbell, the collar comprising:

a first collar portion having a body extending along a curve, wherein the body includes:

an outer radial surface;

an inner radial surface;

a channel extending between the outer radial surface and the inner radial surface, wherein the channel forms a through-hole from the outer radial surface to the inner radial surface;

a blockage disposed within the channel, wherein the blockage comprises an elastomeric material; and a first pad extending radially inward from the inner radial surface of the first collar portion, wherein the first pad includes the same elastomeric material of the blockage, and wherein the first pad is integral with the blockage disposed within the channel.

2. The collar of claim 1, further including a second collar portion having a body extending along a curve, wherein the first collar portion and the second collar portion are coupled to one another and circumscribe an opening extending between the first collar portion and the second collar portion.

3. The collar of claim 2, wherein the body of the second collar portion includes:

a second outer radial surface;

a second inner radial surface; and a second channel extending between the outer radial surface and the inner radial surface, wherein the collar further includes a second pad extending radially inward from the inner radial surface of the second collar portion, wherein the second channel includes a second blockage, and wherein the second blockage is integral with the second pad.

4. The collar of claim 1, wherein the elastomeric material comprises a thermoplastic elastomer.

5. The collar of claim 1, wherein the collar is substantially free of any adhesive bonding the first pad to the first collar portion.

6. The collar of claim 1, wherein the channel is in the shape of an alphanumeric character.

7. The collar of claim 1, wherein the first pad is mechanically interlocked to the first collar portion.

8. The collar of claim 1, wherein the inner radial surface of the first collar portion includes a recess, wherein the recess is defined by a base surface and a rim extending radially inward from the base surface.

9. The collar of claim 8, wherein the first pad is disposed at least partially within the recess.

10. The collar of claim 1, wherein the channel is one of a plurality of spaced-apart channels extending between the outer radial surface and the inner radial surface of the first collar portion, wherein each of the channels is filled with elastomeric material that is integral with the elastomeric material of the first pad.

11. A collar for a barbell, the collar comprising:

a first collar portion having a body extending along a curve, wherein the body includes:

an outer radial surface;

an inner radial surface;

a channel forming a through-hole from the outer radial surface to the inner radial surface; and a first pad extending radially inward from the inner radial surface of the first collar portion, wherein the first pad includes an elastomeric material mechanically interlocked to the inner radial surface of the first collar portion, and wherein the channel is at least partially filled with the elastomeric material of the first pad.

12. The collar of claim 11, wherein the collar is substantially free of any adhesive bonding the first pad to the first collar portion.

13. The collar of claim 11, further comprising a channel in the shape of an alphanumeric character and extending between the outer radial surface and the inner radial surface.

14. The collar of claim 11, further including a second collar portion having a body extending along a curve, wherein the first collar portion and the second collar portion are coupled to one another and circumscribe an opening extending between the first collar portion and the second collar portion.

15. The collar of claim 14, wherein the body of the second collar portion includes:

a second outer radial surface;

a second inner radial surface; and a channel extending between the second outer radial surface and the second inner radial surface, wherein the collar further includes a second pad extending radially inward from the second inner radial surface of the second collar portion, wherein the channel includes a blockage, and wherein the blockage is integral with the second pad.

16. A method of manufacturing a collar for a barbell, the method comprising:

injecting an elastomeric material into one or more channels disposed in an outer radial surface of a first portion of the collar, such that the elastomeric material flows through the one or more channels and into a recess of an inner radial surface of the first portion of the collar; and solidifying the elastomeric material in the one or more channels and the recess to produce a pad at least partially disposed within the recess and mechanically interlocked to the first portion of the collar.

17. The method of claim 16, further comprising:

injecting the elastomeric material into one or more channels disposed in a second outer radial surface of a second portion of the collar, such that the elastomeric material flows through the one or more channels disposed in the second outer radial surface of the second portion of the collar and into a second recess of a second inner radial surface of the second portion of the collar; and solidifying the elastomeric material in the one or more channels disposed in the second outer radial surface of the second portion of the collar and the second recess to produce a second pad at least partially disposed within the second recess and mechanically interlocked to the second portion of the collar.

18. The method of claim 17, further including coupling the first portion and the second portion to one another at a hinge joint so that 1) the first portion and the second portion form the collar surrounding an opening, and 2) the pads from both the first portion and the second portion extend radially inward toward the opening.

19. The method of claim 16, wherein the one or more channels are arranged in an alphanumeric shape.

20. The method of claim 16, wherein the pad is mechanically interlocked to the first portion of the collar without any adhesive.

* * * * *